US007178448B2

(12) United States Patent
Matsumoto et al.

(10) Patent No.: US 7,178,448 B2
(45) Date of Patent: Feb. 20, 2007

(54) AIR SERVO CYLINDER APPARATUS AND CONTROLLING METHOD THEREFOR

(75) Inventors: Daisuke Matsumoto, Tsukuba-gun (JP); Nobuhiro Fujiwara, Tsukuba-gun (JP); Hiroshi Miyachi, Tsukuba-gun (JP)

(73) Assignee: SMC Corporation, Tokyo (JP)

( * ) Notice: Subject to any disclaimer, the term of this patent is extended or adjusted under 35 U.S.C. 154(b) by 0 days.

(21) Appl. No.: 11/081,610

(22) Filed: Mar. 17, 2005

(65) Prior Publication Data

US 2005/0217475 A1 Oct. 6, 2005

(30) Foreign Application Priority Data

Mar. 30, 2004 (JP) ..... 2004-100815

(51) Int. Cl.
*F15B 13/16* (2006.01)

(52) U.S. Cl. ..... 91/361; 91/435; 91/458; 91/459

(58) Field of Classification Search ..... 91/361, 91/390, 404, 435, 458, 459, 465
See application file for complete search history.

(56) References Cited

U.S. PATENT DOCUMENTS 5,494,427 A * 2/1996 Arai ..... 425/145
5,585,053 A * 12/1996 Arai ..... 264/40.1
5,906,778 A * 5/1999 Arai et al. ..... 264/40.1
2003/0079602 A1* 5/2003 Yo et al ..... 91/361
2004/0182231 A1* 9/2004 Yo et al. ..... 91/361

FOREIGN PATENT DOCUMENTS

DE 10122297 C1 6/2002
DE 10248797 A1 5/2003
DE 102004012294 A1 11/2004
EP 1068932 A2 1/2001
EP 1333349 A2 8/2003

* cited by examiner

*Primary Examiner*—Hoang Nguyen
(74) *Attorney, Agent, or Firm*—Oblon, Spivak, McClelland, Maier & Neustadt, P.C.

(57) ABSTRACT

A method for controlling an air servo cylinder apparatus includes an advancing process of advancing a piston up to a target position by controlling, by a controller, servo valves individually connected to a pressure chamber on the head side and that on the rod side of the cylinder, and a pressurizing process of subsequently applying a required pressurizing force to the piston. In the advancing process, the piston starts to be driven with the servo valve on the head side opened to the air intake side and the servo valve on the rod side opened to the exhaust side. Thereafter, the opening degree of the servo valve on the rod side is varied into an opening degree in accordance with a deviation of the current position from the target position, and thereby the piston is smoothly decelerated as it approaches the target position.

11 Claims, 5 Drawing Sheets

AIR SERVO CYLINDER APPARATUS AND CONTROLLING METHOD THEREFOR

TECHNICAL FIELD

The present invention relates to an air servo cylinder apparatus used for pressurizing work, and a controlling method therefor. More specifically, the present invention pertains to an air servo cylinder apparatus and a controlling method therefor capable of reducing the shock at a time when a pressurizing member contacts work, and applying a required pressurizing force to the work in a short time after the contact.

BACKGROUND ART

For example, in a welding gun used for welding work, a common air cylinder is generally used. The welding gun is configured to perform welding operation while applying a required pressurizing force to work after having clamped the work by a clamping mechanism. However, when work is to be clamped, a welding tip may collide against the work and deforms it. This results in poor welding. With this being the situation, the welding gun is formed by an air servo cylinder, and in order to reduce the shock at a time when work is clamped and to shorten the welding time by decreasing pressurization time after the clamping, an air cushion mechanism is attached to the cylinder, as well as a changeover valve or a quick exhaust valve is provided in a drive circuit for the cylinder, whereby the air cylinder is allowed to perform proper operations.

However, the air cushion mechanism attached to the air cylinder can exert a cushioning action only at a specified position such as a stroke end. When work is clamped at a plurality of positions, that is, when the thickness of work varies and target positions are not invariant, a shock reduction by the air cushion cannot be achieved. Also, provision of an air cushion, a changeover valve, and a quick exhaust valve besides servo valves can raise problems of incurring a large size, heavy weight, high cost, short lifetime, low-reliability and the like.

The present inventors have attempted to drive the air cylinder by 5-port servo valves. However, controlling the pressurizing force by the 5-port servo valves separately requires pressure control valves. This has undesirably brought about upsizing and difficulty in cost-reduction.

DISCLOSURE OF THE INVENTION

The object of the present invention is to provide an air servo cylinder apparatus and a controlling method therefor capable of reducing shock at a time when a pressurizing member contacts work, as well as applying a required pressurizing force to the work in a short time after the contact.

To achieve the above-described object, the present invention provides an air servo cylinder apparatus that includes a cylinder having a piston for driving a pressurizing member for work; servo valves individually connected to respective pressure chambers on the head side and the rod side of the cylinder; pressure sensors for detecting the pressures in the respective pressure chambers; a position sensor for detecting operational positions of the cylinder; and a controller outputting control signals to the two servo valves based on detected signals from the pressure sensors and the position sensor.

In the control by the above-described controller, an advancing process of advancing the piston up to a target position where the pressurizing member is to contact work, and a pressuring process of subsequently applying a required pressurizing force to the work, are performed. In the advancing process, in a state where the servo valve on the head side is opened to the air intake side while the servo valve on the rod side is opened to the exhaust side, the piston starts to be driven. Thereafter, in a state where the servo valve on the rod side is left opened to the exhaust side, the valve opening degree thereof is adjusted to become a valve opening degree in accordance with a deviation of the current position from the target position, whereby the piston is smoothly decelerated as it approaches the target position.

The controlling method according to the present invention further includes an intermediate stop process of holding the piston at an intermediate stop position. In the intermediate stop process, the pressure in each of the pressure chambers on the two sides in the pressurizing cylinder is kept lower than the pressure in the pressure chamber on the head side at the time when work is in a clamped state, and the pressures in the pressure chambers on the two sides are kept at values close to each other.

In the above-described advancing process, it is preferable that the opening degree of the servo valve on the head side be controlled in accordance with the aforementioned deviation, or that the servo valve on the head side be controlled in accordance with a deviation of a measured pressure by the corresponding pressure sensor, from a set pressure.

In the present invention, in the advancing process, at the point in time when the speed of the piston has been sufficiently decelerated and the piston has reached a set position that is sufficiently close to the target position, the opening degree of the servo valve on the rod side may be fixed to a minute and constant value, whereby the pressurizing member is brought into contact with work at a constant and low speed.

In the above-described pressurizing process, the pressures in the two pressure chambers in the cylinder may be compared based on signals from the pressure sensors, and at the point in time when the pressure in the pressure chamber on the head side has become higher than the pressure in the pressure chamber on the rod side, the servo valve on the rod side may be fully opened toward the exhaust side, whereby compressed air in the pressure chamber on the rod side may be rapidly discharged.

Furthermore, it is preferable that, after the piston has reached the target position, until the compressed air in the pressure chamber on the rod side is discharged, control be performed so that, by raising the pressure in the pressure chamber on the head side, the difference in the pressure between the pressure chamber on the head side and the pressure chamber on the rod side becomes a desired cylinder thrust. This allows the time before the cylinder thrust reaches the desired cylinder thrust to be reduced.

Thus, the present invention provides advantages in its capability of reducing the shock at a time when a pressurizing member contacts work, and applying a required pressurizing force to the work in a short time after the contact.

BEST MODE FOR CARRYING OUT THE INVENTION

Figure 1:
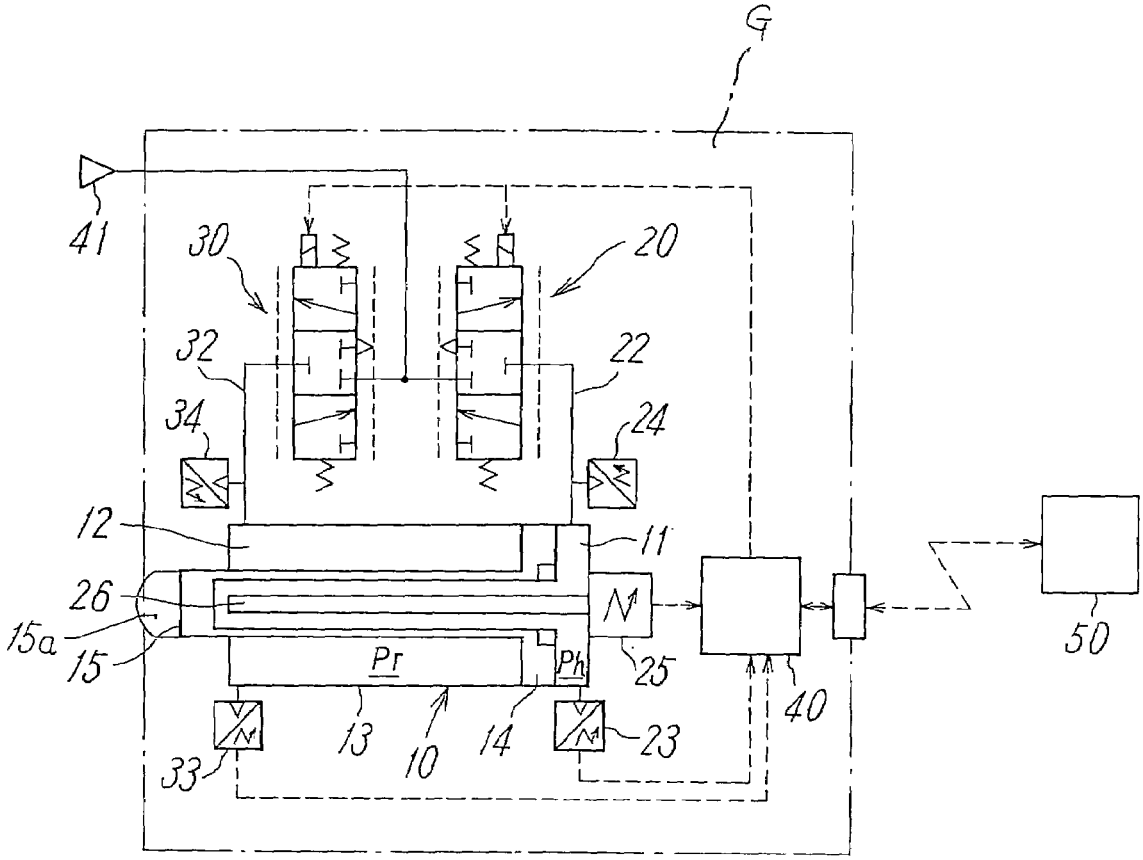
FIG. 1 is a schematic view showing a configuration example of a welding gun for executing a cylinder controlling method according to the present invention, and a control system therefor.

FIG. 1 shows a configuration example of a welding gun as an application of an air servo cylinder apparatus according to the present invention, and a control system therefor.

The welding gun G shown in FIG. 1 includes a cylinder 10 for pressurization, a head-side servo valve 20 for controlling compressed air in the head-side pressure chamber 11 in the cylinder 10, a rod-side servo valve 30 for controlling compressed air in the rod-side pressure chamber 12, a controller 40 outputting signals to these servo valves, and an external controller 50 issuing commands from the outside to the controller 40. The controller 40 controls the cylinder 10, and consequently, the welding gun G to perform desired operations.

The cylinder 10 includes a cylinder tube 13, a piston 14 slidably inserted therethrough, and a piston rod 15 connected to the piston 14. The cylinder 10 is for clamping work using the piston rod 15. The cylinder tube 13 is a sealed cylindrical member, and includes a pressure chamber 11 on the head side of the piston 14 and a pressure chamber 12 on the rod side thereof, with the piston 14 interposed therebetween. The piston rod 15 hermetically passes through the cylinder tube 13 and extend toward the outside. To the end of the piston rod 15, extending to the outside, one electrode member out of a pair of electrode members of the welding gun is mounted as a pressurizing member 15*a* for pressurizing work while maintaining contact with it.

The head-side pressure chamber 11 is for driving the piston 14 by compressed air that is supplied and discharged from the head-side servo valve 20 through a flow path 22. The head-side pressure chamber 11 includes a head-side pressure sensor 23 for detecting the pressure in this chamber, and a probe 26 of a position detecting sensor 25 for detecting the drive position of the piston 14, the probe 26 being inserted through the piston 14 from the head cover side. Each of the outputs of the head-side pressure sensor 23 and the position detecting sensor 25 is outputted to the controller 40.

On the other hand, the rod-side pressure chamber 12 is for driving the piston 14 by compressed air that is supplied and discharged from the rod-side servo valve 30 through a flow path 32. The rod-side pressure chamber 12 has a rod-side pressure sensor 33 for detecting the pressure in this chamber. The output of the rod-side pressure sensor 33 is also outputted to the controller 40.

Each of the head-side servo valve 20 and the rod-side servo valve 30 is a three-port valve including an intake port for introducing compressed air from a supply source 41 of compressed air, an output port for outputting this compressed air, and an output port for discharging it. This three-port servo valve is for causing the above-described ports to communicate with one another as appropriate in accordance with output signals from the controller 40, and thereby allowing controlled compressed air to flow. The servo valves 20 and 30 have substantially the same construction.

The controller 40 incorporates a microprocessor, and detected values by the head-side and rod-side pressure sensors 23 and 33, and the position detecting sensor 25 are inputted to the microprocessor. Also, information such as operational positions and intermediate stop positions of the piston 14 is inputted to and stored in the controller 40. Such information may be inputted either as digital values or as analog values such as voltages and currents. Based on command signals inputted from the external controller 50 and instructing for the execution of welding, such as "intermediate stop", "clamping", and "application of pressurizing force", the aforementioned detected values and set values are compared, and drive signals are outputted to the head-side servo valve 20 and the rod-side servo valve 30 so that the cylinder 10 performs a predetermined operation.

In FIG. 1, reference numerals 24 and 34, respectively, denote pressure sensors provided in the flow paths 22 and 32 extending from the servo valves 20 and 30 to the pressure chambers 11 and 12, respectively.

Next, the functions of the controller 40 and the controlling method of the welding gun G by the controller 40 will be described.

In the control of the welding gun, basically, by controlling the piston 10, an advancing process of moving the electrode member 15*a* up to a clamping position (target position) where the electrode member 15*a* is to contact work, a pressurizing process of subsequently applying a required clamping force (pressurizing force) to the work by the electrode member 15*a*, and an intermediate stop process of retreating the electrode member 15*a* after welding and stopping it at an intermediate position, are performed. Herein, the pressures in the pressure chambers 11 and 12 in the cylinder 10 are detected by the pressure sensors 23 and 33, respectively; the position of the piston 14 is detected by the position detecting sensor 25; and the servo valves 20 and 30, respectively, are controlled to properly adjust the pressures in the pressure chambers 11 and 12. Thereby, the pressurizing force (clamping force) of the welding gun is correctly controlled, resulting in an improved welding quality. Here, detecting both of the head-side pressure Ph and the rod-side pressure Pr makes it possible to detect the cylinder thrust based on these pressures Ph and Pr, thereby the cylinder 10 is controlled, as described later in detail.

In the control of the cylinder, an air servo cushion is adopted. Specifically, the position and the speed of the piston 14 in the cylinder 10 are detected by the position detecting sensor 25, while the pressures in the pressure chamber 11 and 12 are detected by the pressure sensor 23 and 33, respectively, and these detected values are inputted to the controller 40. The controller 40 outputs signals to the servo valves 20 and 30 for driving thereof so as to control the position of the piston 14 and the pressures in the pressure chambers 11 and 12, and to prevent the welding tip from colliding against work and giving a shock to work. In this case, because the servo valves 20 and 30 are used to exert a cushioning function, no special mechanism for reducing the shock is needed, thereby allowing the reduction of the installation space and the weight of the cylinder 10 and surrounding equipment for providing cushioning functionality.

With reference to time charts shown in FIGS. 2A to 2C and subsequent figures, the controlling method for the welding gun and operations thereof will be described in detail below.

Figure 2:
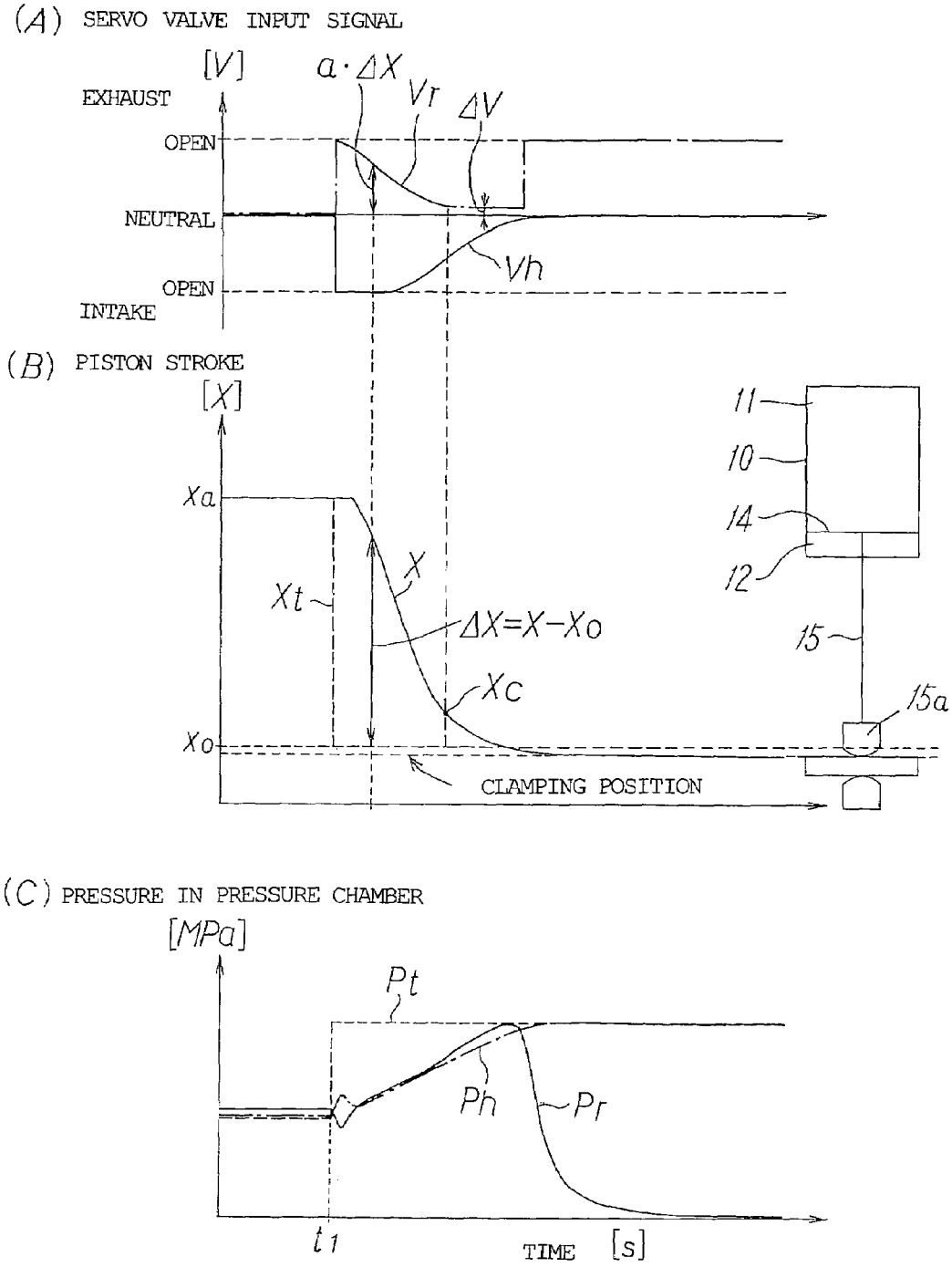
FIGS. 2A to 2C are time charts for explaining an example of controlling method according to the present invention.

FIG. 2A shows input signals inputted to the two servo valves 20 and 30 when the cylinder 10 is driven from an arbitrary intermediate stop position up to a clamping position in the above-described advancing process; FIG. 2B shows a piston stroke at this time; and FIG. 2C shows pressures in the head-side and rod-side pressure chambers 11 and 12 at this time.

Basic operations of the welding gun are now described with reference to FIGS. 2A to 2C. First, as shown in FIG. 2A, at a time t1, an input signal represented by a curve Vh is inputted to the head-side servo valve 20, and the intake side of the servo valve 20 is fully opened or near-fully opened. On the other hand, an input signal represented by a curve Vr is applied to the rod-side servo valve 30, and the exhaust side of the servo valve 30 is fully opened.

As a result, as shown in FIG. 2B, the piston 14, having been located at an arbitrary position (Xa) is driven at a high speed from this position toward a work clamping position (Xo), which is a target position Xt.

As shown in FIG. 2C, regarding the pressures in the head-side and rod-side pressure chambers 11 and 12, the pressure Ph in the head-side pressure chamber 11 once becomes higher than the pressure Pr in the rod-side pressure chamber 12. As a consequence, the piston 14 moves and compresses air in the rod-side pressure chamber 12, so that both the pressures Ph and Pr complicatedly vary.

After having started the driving of the piston 14 as described above, the head-side servo valve 20 is pressure-controlled along the curves illustrated in FIG. 2C. On the other hand, regarding the rod-side servo valve 30, in a state where it is left opened to the exhaust side, the valve opening degree thereof is continuously controlled along a linear or smooth curve so as to becomes an opening degree in accordance with an input signal ($a \cdot \Delta X$; here, "a" is a constant) in proportion to a deviation of the current position X of the piston 14 from a target position Xo, i.e., $\Delta X = X - Xo$. This makes it possible to smoothly decelerate the piston 14 as it approaches the target position, and bring the electrode member 15*a* into contact with work in a cushioned manner.

In this case, it is desirable that the opening degree of the head-side servo valve 20 be reduced in accordance with the aforementioned deviation $\Delta X$, or that the opening degree be adjusted in accordance with the deviation of a measured pressure in the head-side pressure chamber 11 by the head-side pressure sensor 23 from the pressure therein at the time when work is in a clamped state (i.e., a set pressure) so that the measured pressure and the set pressure become equal to each other.

In the illustrated example, with the start of the driving of the piston 14, the opening degree of the rod-side servo valve 30 is smoothly varied, while that of the head-side servo valve 20 starts to be varied at a time a little later than the start of the driving of the piston 14.

In the above-described advancing process, it is preferable that the piston be sufficiently decelerated, and that, at the point in time when the piston has reached a set position (Xc) by sufficiently approaching the target position, the servo valve opening degree ($\Delta V$) of the rod-side servo valve 30 be fixed to a minute constant value. This enables the electrode member 15*a* to contact work at a constant and low speed.

Figure 3:
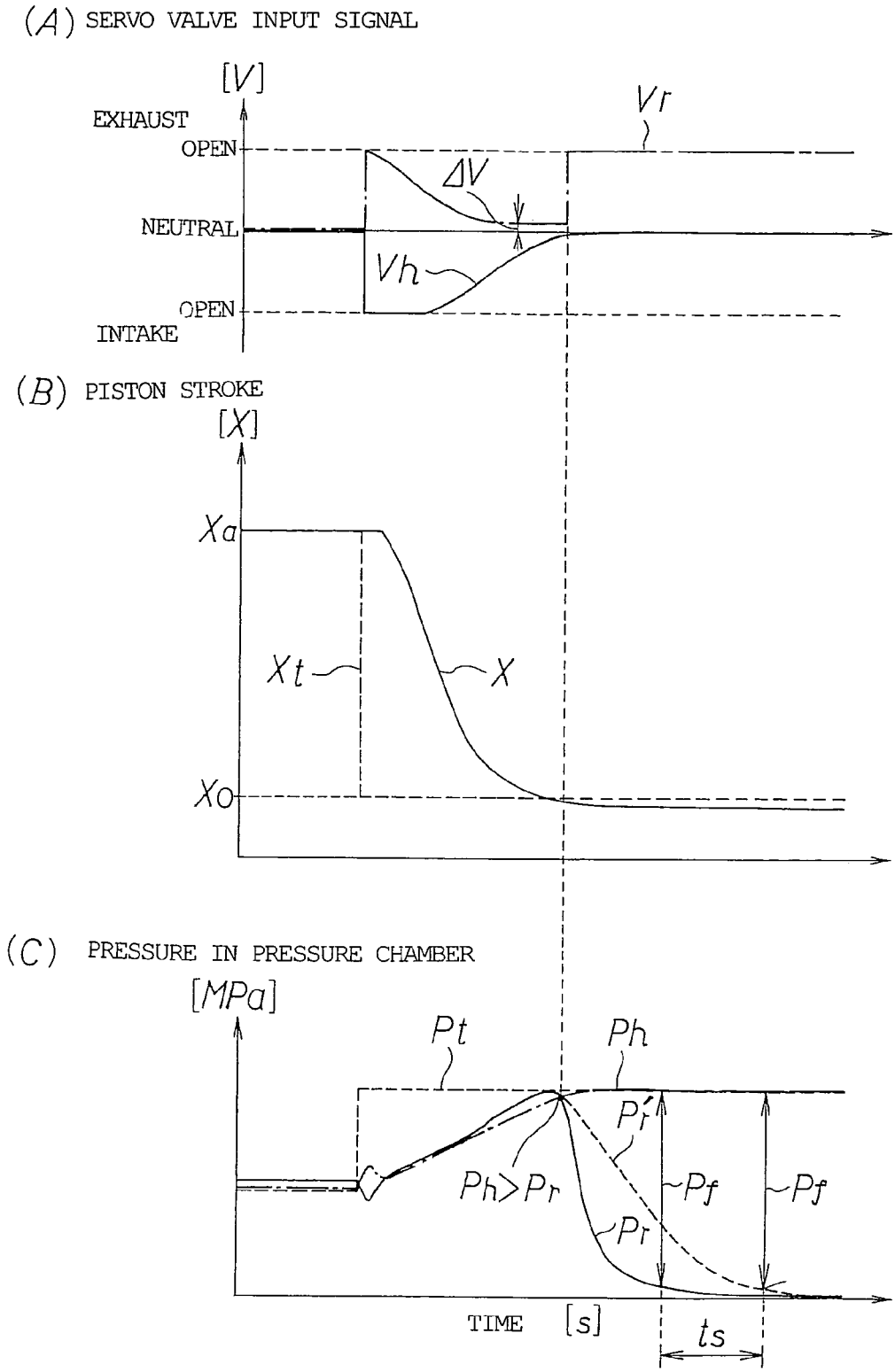
FIGS. 3A to 3C are time charts for explaining another example of controlling method according to the present invention.

After the piston 14 has reached the clamping position, and the piston rod 15 has contacted the work as described above, the above-described pressurizing process are subsequently performed, and the work is welded in a pressurized state. During this pressurizing process, in the controller 40, signals indicating pressures in the two pressure chambers 11 and 12 in the cylinder 10 and being issued from the pressure sensors 23 and 33 are monitored. As shown in FIG. 3C, at the point in time when the pressure Ph in the head-side pressure chamber 11 has become higher than the pressure Pr in the rod-side pressure chamber 12, the rod-side servo valve 30, having been fixed to a definite servo valve opening degree ($\Delta V$), is fully opened toward the exhaust side, and thereby compressed air in the rod-side pressure chamber 12 is rapidly discharged. Thereby, in comparison with the case where the rod-side servo valve 30 is provided with a given opening degree $\Delta V$ (here, the pressure in the rod-side pressure chamber is Pr' as indicated by a dotted line in FIG. 3C), the time before a clamping force is acquired based on a specified cylinder thrust Pf can be reduced to a minimum. In the illustrated example, the aforementioned time can be shortened by a time ts.

Figure 4:
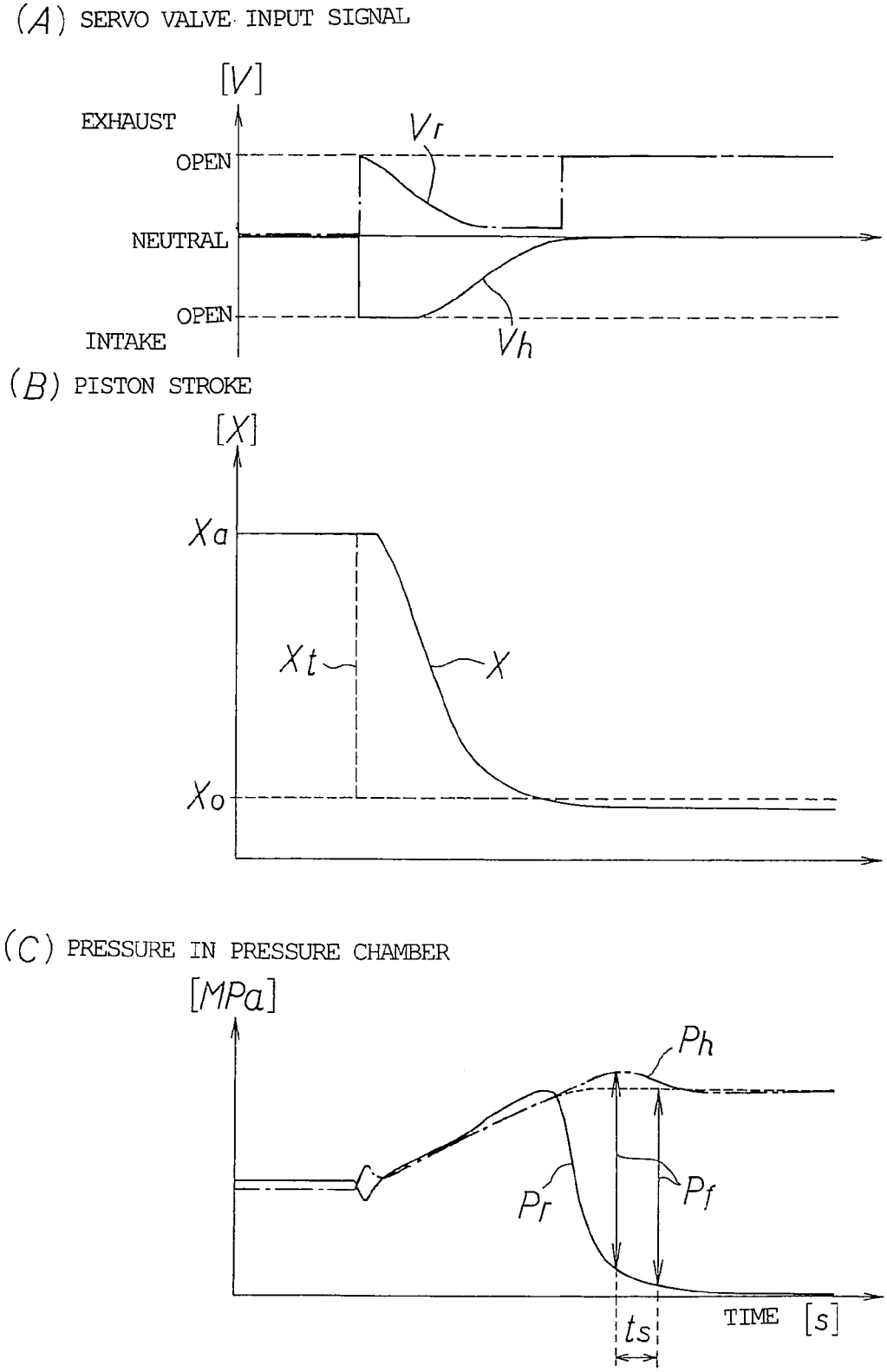
FIGS. 4A to 4C are time charts for explaining still another example of controlling method according to the present invention.

Also, as shown in FIG. 4C, raising the pressure in the head-side pressure chamber 11 until compressed air (pressure: Pr) in the rod-side pressure chamber 12 is discharged, and performing control such that the difference (Ph−Pr) between the pressure Ph in the head-side pressure chamber 11 and the pressure Pr in the rod-side pressure chamber 12 becomes the pressure difference Pf for acquiring a desired cylinder thrust, allows the time before the desired cylinder thrust is reached, to be reduced by the time ts. This enables clamped work to be quickly pressurized.

Figure 5:
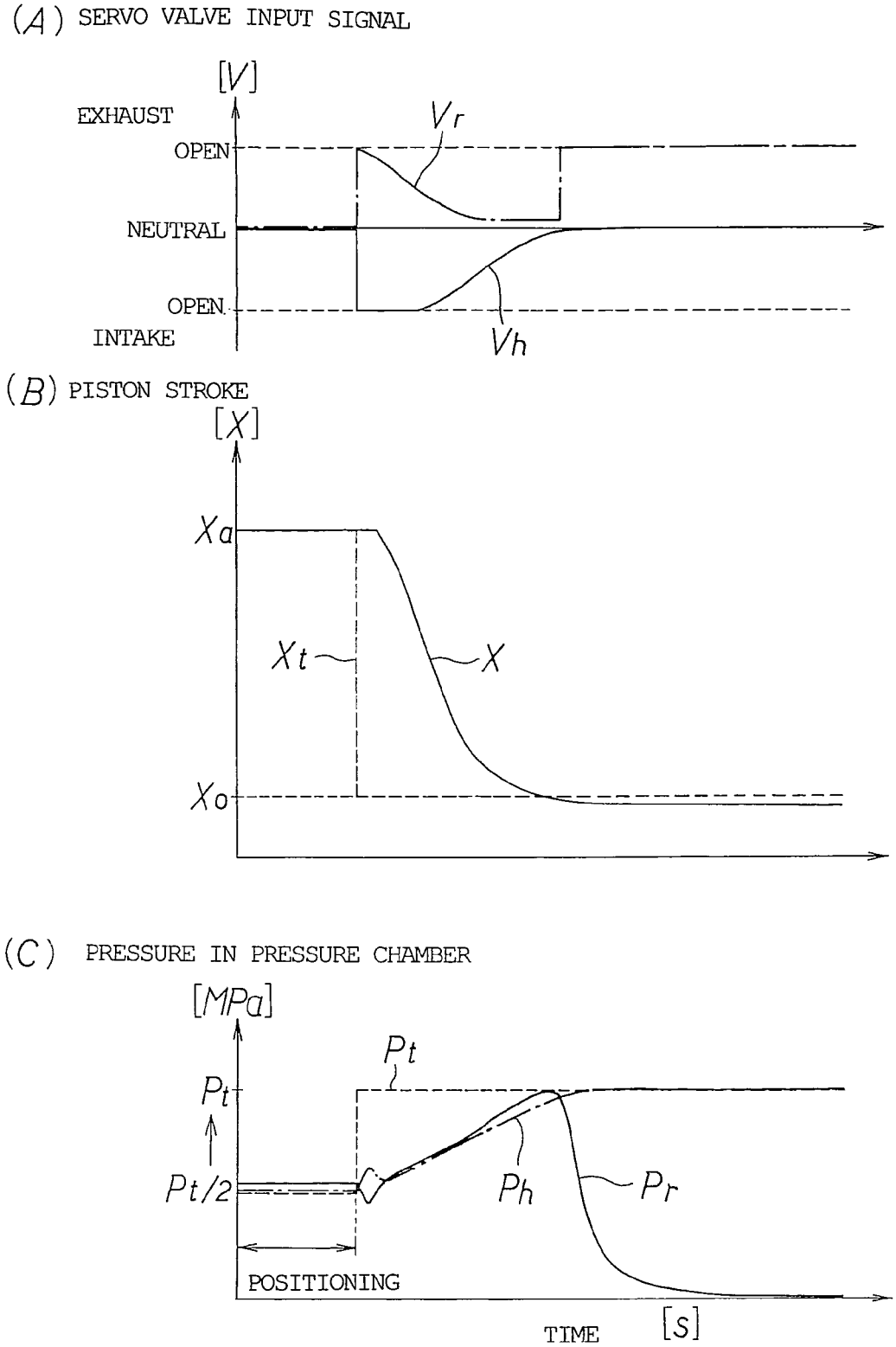
FIGS. 5A to 5C are time charts for explaining a further example of controlling method according to the present invention.

After the above-described pressurizing process and welding have been performed, the intermediate stop process is performed in which the electrode member 15*a*, and consequently, the piston 14 is retreated and stopped at an arbitrary position. As shown in FIG. 5C, at this intermediate stop position, it is desirable that the pressure in each of the pressure chambers 11 and 12 on the two sides of the cylinder 10 be kept lower than the target pressure Pt in the head-side pressure chamber at the time when work is in a clamped state. Specifically, the pressure in each of the pressure chambers 11 and 12 is preferably on the order of two-thirds to one-third the target pressure Pt, and more preferably, around one-half the target pressure Pt. Herein, the pressure chambers 11 and 12 may have substantially the same pressure, but it is desirable that the pressure Pr in the rod-side pressure chamber 12 be kept a little higher than the pressure Ph in the head-side pressure chamber 11 by a pressure corresponding to the difference in the pressure-receiving area due to the presence or absence of the piston rod 15, to keep the acting forces on the head and rod sides in balance.

Thereby, when attempting to start the clamping operation, it is possible to reduce the delay time before the piston 14 starts to move, as well as to save the amount of air pressure used. Specifically, a trial calculation has clarified that making the pressure in each of the two pressure chambers 11 and 12 to Pt/2, reduces the amount of air usage to about one half. In addition, when the cylinder 10 is at the intermediate stop position, the air leakage from the servo valves can also be saved.

The above-described embodiment is an implementation in which the present invention is applied to a welding gun. Besides such a welding gun, the present invention can also be applied to general machining techniques to machine work in a chucked state.

The invention claimed is:

1. A method for controlling an air servo cylinder apparatus that includes a cylinder having a piston for driving a pressurizing member for work, servo valves individually connected to respective pressure chambers on the head side and the rod side of the cylinder, pressure sensors for detecting the pressures in the respective pressure chambers, a position sensor for detecting operational positions of the cylinder, and a controller outputting control signals to the two servo valves based on detected signals from the pressure sensors and the position sensor, the method comprising, in the control by the controller, the following processes:

an advancing process of advancing the piston up to a target position where the pressurizing member is to contact work; and a pressuring process of subsequently applying a required pressurizing force to the work, wherein, in the advancing process, in a state where the servo valve on the head side is opened to the air intake side while the servo valve on the rod side is opened to the exhaust side, the piston starts to be driven;

thereafter, the servo valve on the head side is controlled in accordance with a deviation between a measured pressure of the pressure chamber on the head side by the corresponding pressure sensor and a pressure when clamping, and the servo valve on the rod side is left opened to the exhaust side, the valve opening degree thereof is adjusted to become a valve opening degree in accordance with a deviation of the current position of the piston from the target position, whereby the piston is smoothly decelerated as it approaches the target; and wherein, in the pressurizing process, the pressures in the two pressure chambers in the cylinder are compared based on signals from the pressure sensors, and at the point in time when the pressure in the pressure chamber on the head side has become higher than the pressure in the pressure chamber on the rod side, the servo valve on the rod side is fully opened toward the exhaust side, whereby compressed air in the pressure chamber on the rod side is rapidly discharged.

2. The control method according to claim 1, further comprising an intermediate stop process of making the piston move back and stop an intermediate stop position, wherein, in the intermediate stop process, the pressure in each of the pressure chambers on the two sides in the pressurizing cylinder is kept lower than the pressure in the pressure chamber on the head side at the time when work is in a clamped state; and the pressure in the pressure chamber on the rod side is kept higher than the pressure in the pressure chamber on the head side by a pressure corresponding to the difference in the pressure-receiving area due to the presence or absence of the rod.

3. The control method according to claim 1, wherein, in the advancing process, at the point in time when the piston has been sufficiently decelerated and has reached a set position that is sufficiently close to the target position, the valve opening degree of the servo valve on the rod side is fixed to a minute constant value, whereby the pressurizing member is brought into contact with work at a constant and low speed.

4. The control method according to claim 2, wherein, in the advancing process, at the point in time when the piston has been sufficiently decelerated and has reached a set position that is sufficiently close to the target position, the valve opening degree of the servo valve on the rod side is fixed to a minute constant value, whereby the pressurizing member is brought into contact with work at a constant and low speed.

5. The control method according to claim 1, wherein, after the piston has reached the target position, until the compressed air in the pressure chamber on the rod side is discharged, control is performed so that, by raising the pressure in the pressure chamber on the head side, the difference in the pressure between the pressure chamber on the head side and the pressure chamber on the rod side becomes a desired cylinder thrust, whereby the time before the cylinder thrust reaches the desired cylinder thrust is reduced.

6. A method for controlling an air servo cylinder apparatus that includes a cylinder having a piston for driving a pressurizing member for work, servo valves individually connected to respective pressure chambers on the head side and the rod side of the cylinder, pressure sensors for detecting the pressures in the respective pressure chambers, a position sensor for detecting operational positions of the cylinder, and a controller outputting control signals to the two servo valves based on detected signals from the pressure sensors and the position sensor, the method comprising, in the control by the controller, the following processes:

an intermediate stopping process to hold the piston at an intermediate stop position;

an advancing process of advancing the piston up to a target position where the pressurizing member is to contact work; and a pressuring process of subsequently applying a required pressurizing force to the work, wherein, in the intermediate stop process, the pressure in each of the pressure chambers on the two sides in the pressurizing cylinder is kept lower than the pressure in the pressure chamber on the head side at the time when work is in a clamped state, and the pressure in the pressure chamber on the rod side is kept higher than the pressure in the pressure chamber on the head side by a pressure corresponding to the difference in the pressure-receiving area due to the presence or absence of the rod, wherein, in the advancing process, in a state where the servo valve on the head side is opened to the air intake side while the servo valve on the rod side is opened to the exhaust side, the piston starts to be driven;

thereafter, the servo valve on the head side is controlled in accordance with a deviation between a measured pressure of the pressure chamber on the head side by the corresponding pressure sensor and a pressure when clamping, and in a state where the servo valve on the rod side is left opened to the exhaust side, the valve opening degree thereof is adjusted to become a valve opening degree in accordance with a deviation of the current position of the piston from the target position, whereby the piston is smoothly decelerated as it approaches the target position, and at the point in time when the piston has been reached a set position that is sufficiently close to the target position, the valve opening degree of the servo valve on the rod side is fixed to a minute constant value, whereby the piston is breached to the target position in a low speed, wherein, in the pressurizing process, the pressures in the two pressure chambers in the cylinder are compared based on signals from the pressure sensors; and at the point in time when the pressure in the pressure chamber on the head side has become higher than the pressure in the pressure chamber on the rod side, the servo valve on the rod side is fully opened toward the exhaust side, whereby compressed air in the pressure chamber on the rod side is rapidly discharged so as to generate a desired cylinder thrust.

7. The control method according to claim 6, wherein, after the piston has reached the target position, until the compressed air in the pressure chamber on the rod side is discharged, control is performed so that, by raising the pressure in the pressure chamber on the head side, the difference in the pressure between the pressure chamber on the head side and the pressure chamber on the rod side becomes a desired cylinder thrust, whereby the time before the cylinder thrust reaches the desired cylinder thrust is reduced.

8. An air servo cylinder apparatus, comprising:

a cylinder pressurizing work by a pressurizing member driven by a piston;

servo valves individually connected to respective pressure chambers on the head side and the rod side of the cylinder;

pressure sensors for detecting the pressures in the respective pressure chambers;

a position sensor for detecting operational positions of the cylinder; and a controller outputting control signals to the two servo valves based on detected signals from the pressure sensors and the position sensor, wherein the controller is configured to have the control functions as defined in claim 1.

9. The control method according to claim 1, further comprising an intermediate stop process of making the piston move back and stop at an intermediate stop position, wherein, in the intermediate stop process, the pressure in each of the pressure chambers on the two sides in the pressurizing cylinder is lower than the pressure in the pressure chamber on the head side at the time when work is in a clamped state.

10. The control method according to claim 9, wherein, in the advancing process, at the point in time when the piston has been sufficiently decelerated and has reached a set position that is sufficiently close to the target position, the valve opening degree of the servo valve on the rod side is fixed to a minute constant value, whereby the pressurizing member is brought into contact with work at a constant and low speed.

11. An air servo cylinder apparatus, comprising:

a cylinder pressurizing work by a pressurizing member driven by a piston;

servo valves individually connected to respective pressure chambers on the head side and the rod side of the cylinder;

pressure sensors for detecting the pressures in the respective pressure chambers;

a position sensor for detecting operational positions of the cylinder; and a controller outputting control signals to the two servo valves based on detected signals from the pressure sensors and the position sensor, wherein the controller is configured to have the control functions as defined in claim 6.

* * * * *